US008381651B1

(12) United States Patent
Presutti, Jr. et al.

(10) Patent No.: US 8,381,651 B1
(45) Date of Patent: Feb. 26, 2013

(54) ROTATIONAL VARIABLE PYROTECHNIC DELAY SELECTOR FOR MUNITIONS

(75) Inventors: Thomas Michael Presutti, Jr., Long Valley, NJ (US); Nicholas Liggett Grossman, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/223,722

(22) Filed: Sep. 1, 2011

(51) Int. Cl.
*F42C 9/02* (2006.01)

(52) U.S. Cl. ..... 102/270; 102/202.13; 102/265; 102/266; 102/269; 102/271; 102/277.2

(58) Field of Classification Search ..... 102/277.2, 102/202, 202.12, 202.13, 217, 228, 238, 102/268, 270, 271, 276, 335, 222, 254, 269, 102/275.11, 277.1
See application file for complete search history.

(56) References Cited

U.S. PATENT DOCUMENTS 3,994,233 A * 11/1976 Travor et al. ..... 102/277.2
2009/0235838 A1* 9/2009 Hultman ..... 102/335

* cited by examiner

*Primary Examiner* — Stephen M Johnson
*Assistant Examiner* — John D Cooper
(74) *Attorney, Agent, or Firm* — Michael C. Sachs

(57) ABSTRACT

A rotational variable pyrotechnic delay selector for munitions which permits the selection of various ignition delays. Advantageously, the variable delay selector is configurable for a variety of field conditions and targets and is adaptable to a number of munitions systems and pyrotechnic ignition mixtures and delays.

1 Claim, 5 Drawing Sheets

ROTATIONAL VARIABLE PYROTECHNIC DELAY SELECTOR FOR MUNITIONS

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of munitions. More particularly, it pertains to an apparatus and method for providing a variable delay to the detonation of munitions such that it exhibits a user-selectable range.

BACKGROUND OF THE DISCLOSURE

Contemporary munitions utilize a pyrotechnic delay that exhibits only a single engagement range. Consequently, different munitions exhibiting a different delay are required to engage targets at different downfield range(s). As a result, the transportation and logistics of range specific munitions is required.

SUMMARY OF THE DISCLOSURE

An advance in the art is made according to an aspect of the present disclosure directed to a rotational variable pyrotechnic delay selector for munitions.

Viewed from a first aspect, the present disclosure is directed to a rotational variable delay selector comprising a body which houses multiple pyrotechnic delay column mixtures and a rotating selector which rotates about the body thereby selecting a particular delay characteristic. An exemplary embodiment of the rotational variable selector comprises the body containing a number of different delay column mixtures, and a rotational selector rotatable around the body such that upon rotating the selector around the body an igniter mixture is aligned with one of the delay column mixtures thereby imparting the particular delay characteristic.

BRIEF DESCRIPTION OF THE DRAWING

A more complete understanding of the present disclosure may be realized by reference to the accompanying drawings in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Figure 1:
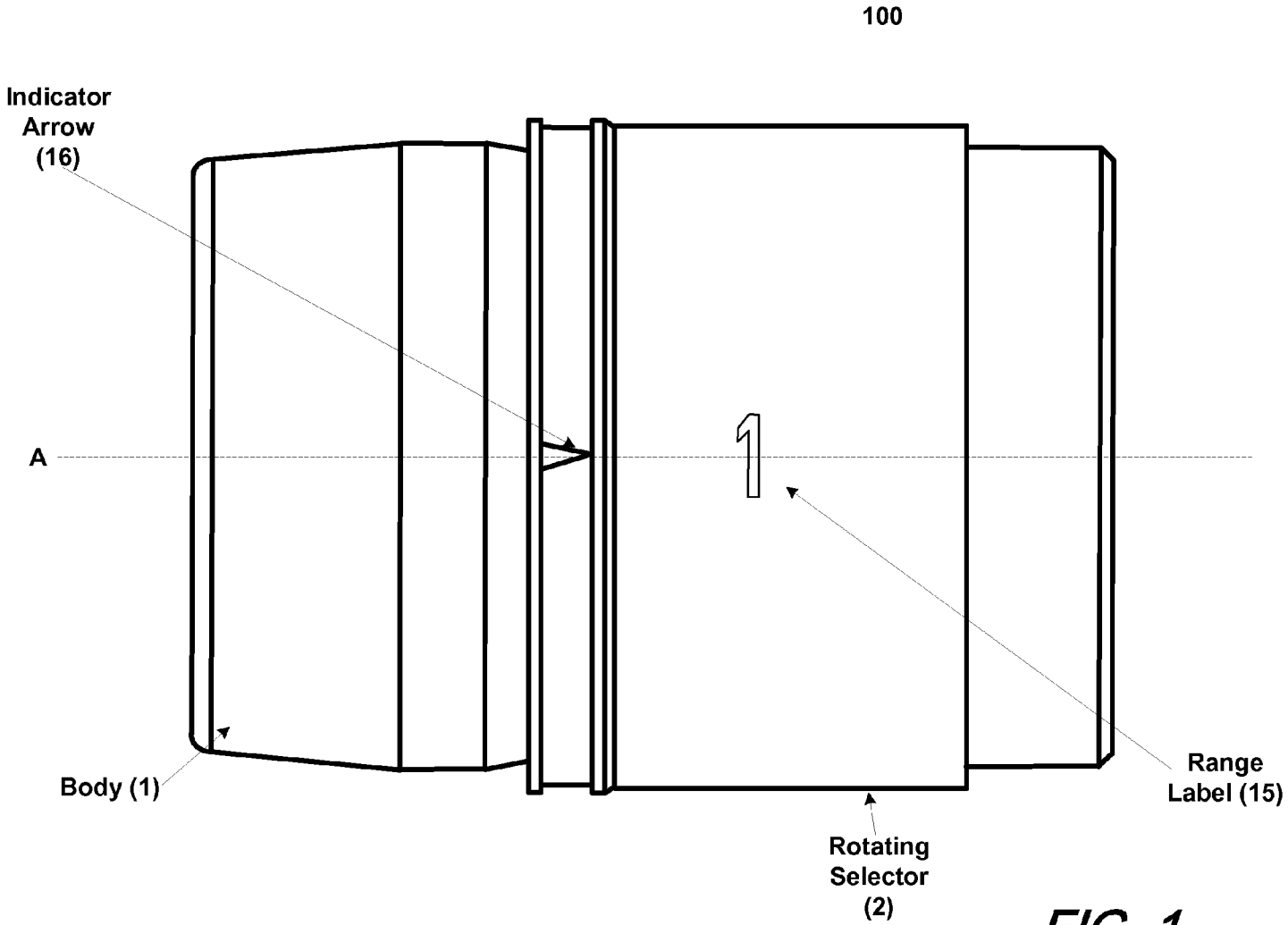
FIG. 1 is a schematic diagram showing a rotational variable pyrotechnic delay selector according to an aspect of the present disclosure.

With reference now to FIG. 1, there is shown a schematic diagram of an exemplary rotational variable pyrotechnic delay selector 100 according to an aspect of the present disclosure. As shown, an exemplary delay selector 100 according to the present disclosure generally includes a body 1 which contains the pyrotechnic delay compositions/mixtures—as well as other components to be shown later—and a rotating selector 2 which is rotatable around the body 1. As may be appreciated, and according to an aspect of the present disclosure, by rotating the selector 2 a variable amount of delay may be imparted to the particular munition to which the selector is integrated. Range label(s) 15 and an indicator arrow 16 provide visual feedback to an operator indicative of the amount of delay selected.

Figure 2:
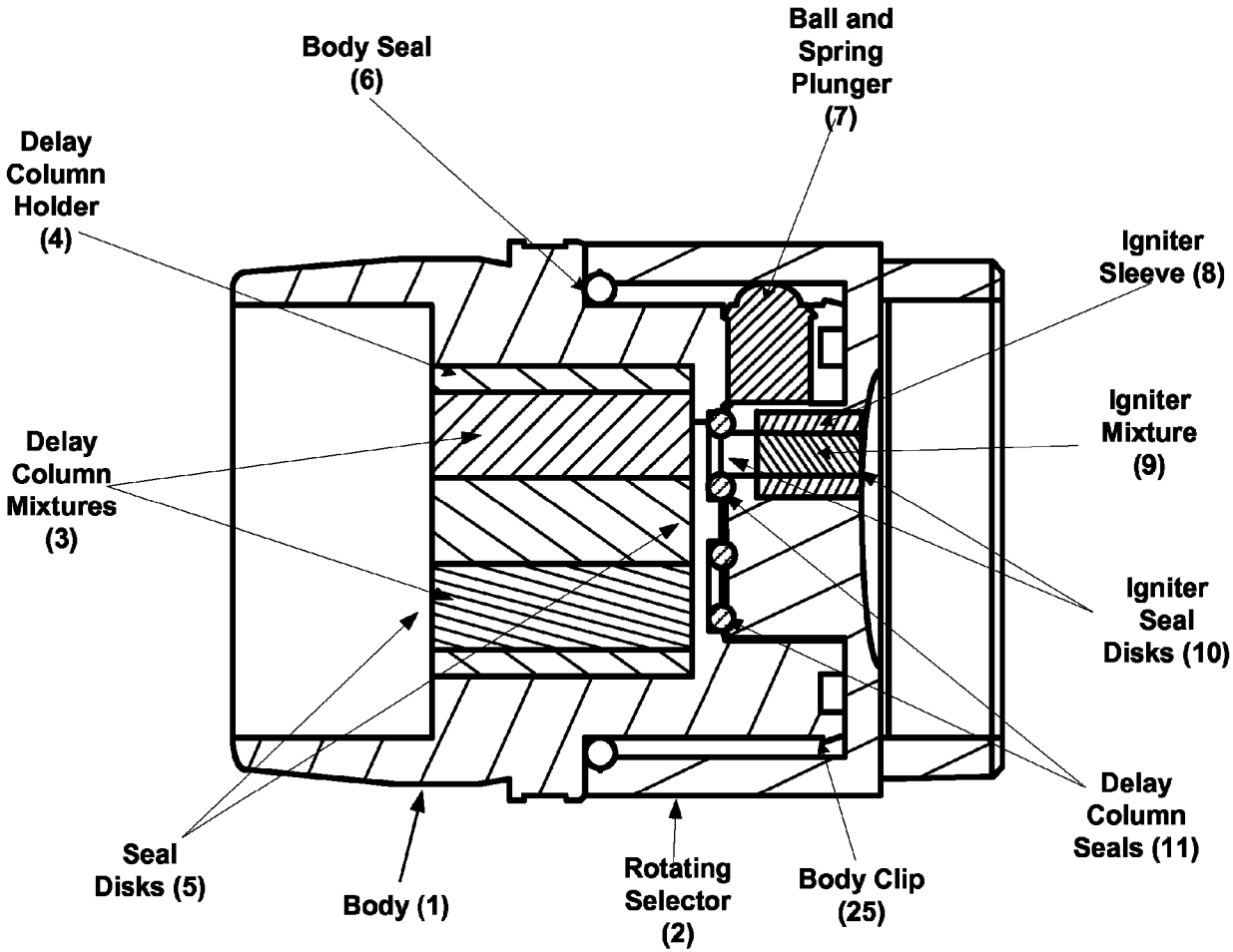
FIG. 2 is a cutaway schematic diagram showing the rotational variable pyrotechnic delay selector according to an aspect of the present disclosure.

FIG. 2 is a cutaway schematic diagram showing the rotational variable pyrotechnic delay selector of FIG. 1 according to an aspect of the present disclosure. As shown in FIG. 2 the body 1 contains a delay column holder 4 which in turn includes a number of delay column mixtures 3. As may be appreciated, each of the mixtures 3 may be formulated to exhibit different burn characteristics such that a different delay may be imparted to a munition depending upon which one of the mixtures 3 is employed.

Rotating selector 2 includes an igniter mixture 9 which rotates along with the selector 2. When the rotating selector 2 is rotated relative to the body 1, the igniter mixture 9 is aligned with a different one of the delay column mixtures 3 such that the aligned mixture becomes part of the ignition train (the igniter mixture and delay column mixture). Consequently, different delay characteristics of the munition are selectable by rotating the selector.

As may be further observed by inspection of FIG. 2, various mechanical components i.e., the ball and spring plunger 7 and the body clip 25 are used to secure the selector 2 in a rotated position and to the body 1 respectively. Various seals 5, 6, 10 and 11 serve to seal the energetic mixtures and isolate them from the environment. Those skilled in the art will immediately appreciate that a variety of mechanical rotatable mechanisms are contemplated by this disclosure and it should not be limited to the particular exemplary embodiment shown in this FIG. 2 or the others. In particular, any of a variety of known sealing mechanisms, locking mechanisms, and/or retaining mechanisms are contemplated for the body and the rotating selector and the components contained therein. Such variations are merely a matter of design choice and/or manufacturing convenience.

Figure 3:
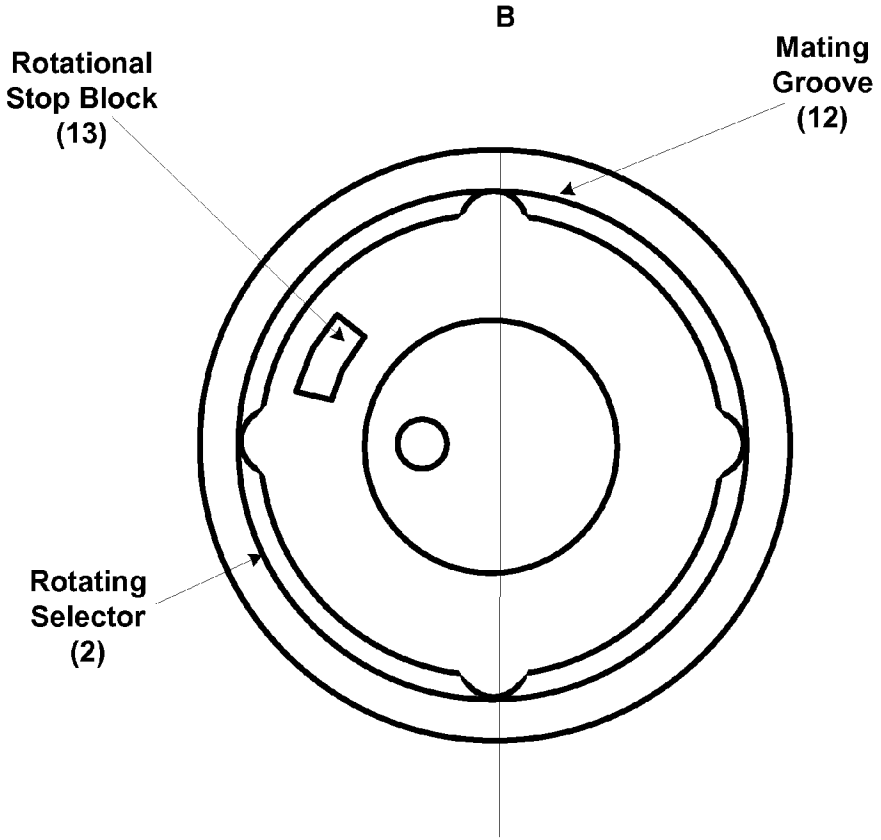
FIG. 3 is a schematic diagram showing a bottom view of the rotational variable pyrotechnic delay selector according to an aspect of the present disclosure.

FIG. 3 is a schematic diagram showing a bottom view of the rotatable variable delay selector according to an aspect of the present disclosure. Shown in this FIG. 3 is the rotating selector 2 relative to a mating groove 12 which permits the secure rotational alignment of the selector to the body and a rotational stop block 13 which limits rotational travel of the selector 2. The rotational stop block 13—by limiting the rotational travel of the selector 2 about the body advantageously provides a "home" or known position of the configuration. More particularly, in a low visibility or "fog of war" situation, a user of the rotatable variable delay selector merely has to rotate the selector in a particular direction until it is stopped through the effect of the rotational stop block 13, then, the user merely rotates the selector in an opposite direction until the desired delay is selected. Advantageously, through the use of the ball and spring plunger 7—an audible and tactile feedback is provided to the user so that (s)he may merely count clicks to know what delay is selected. Finally—in a preferred embodiment—the stop or home position may be where a first delay is selected while the opposite rotational stop may be a last delay selection. In this manner, if the first or last delay is desired, the user merely has to rotate the selector in an appropriate direction until the positive stop is realized. As before, variations to this arrangement are contemplated.

Figure 4:
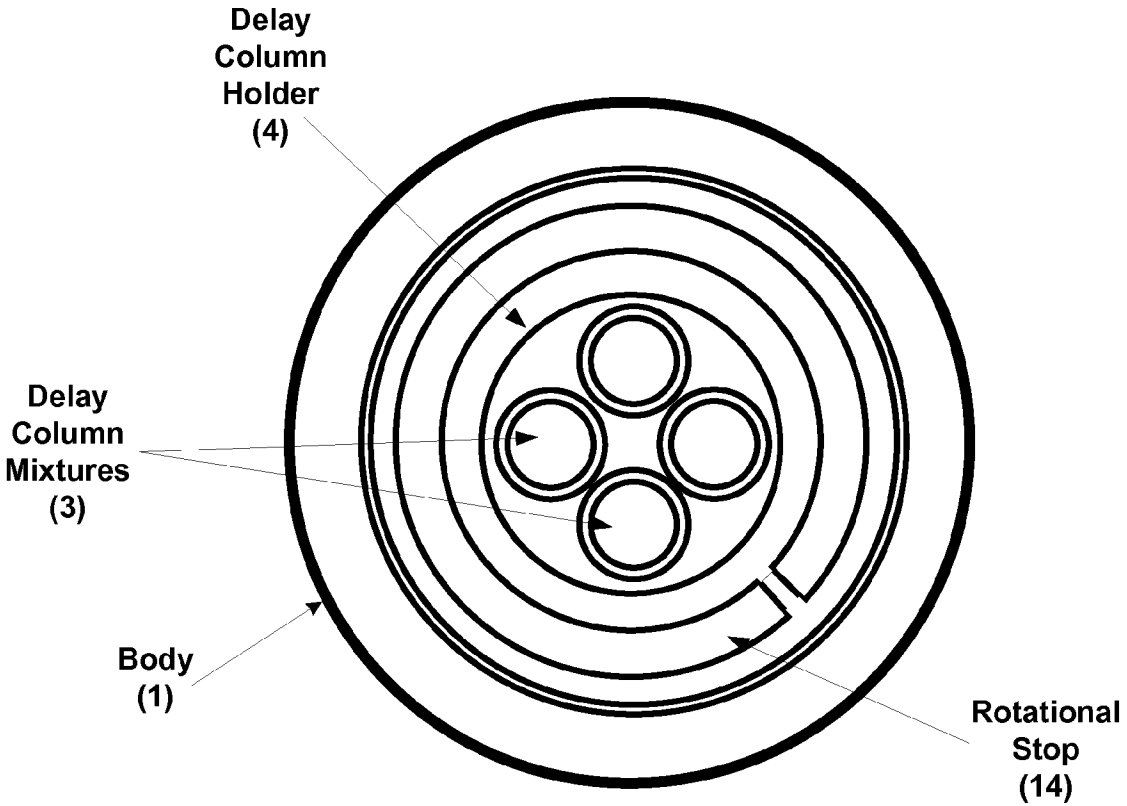
FIG. 4 is a schematic diagram showing top view of the rotational variable pyrotechnic delay selector according to an aspect of the present disclosure.

FIG. 4 is schematic diagram showing a top view of the rotatable variable delay selector according to an aspect of the present disclosure. Shown in this FIG. 3 is the body 1 containing the rotational stop 14 and delay column holder 4 including a number of delay column mixtures 3.

Figure 5:
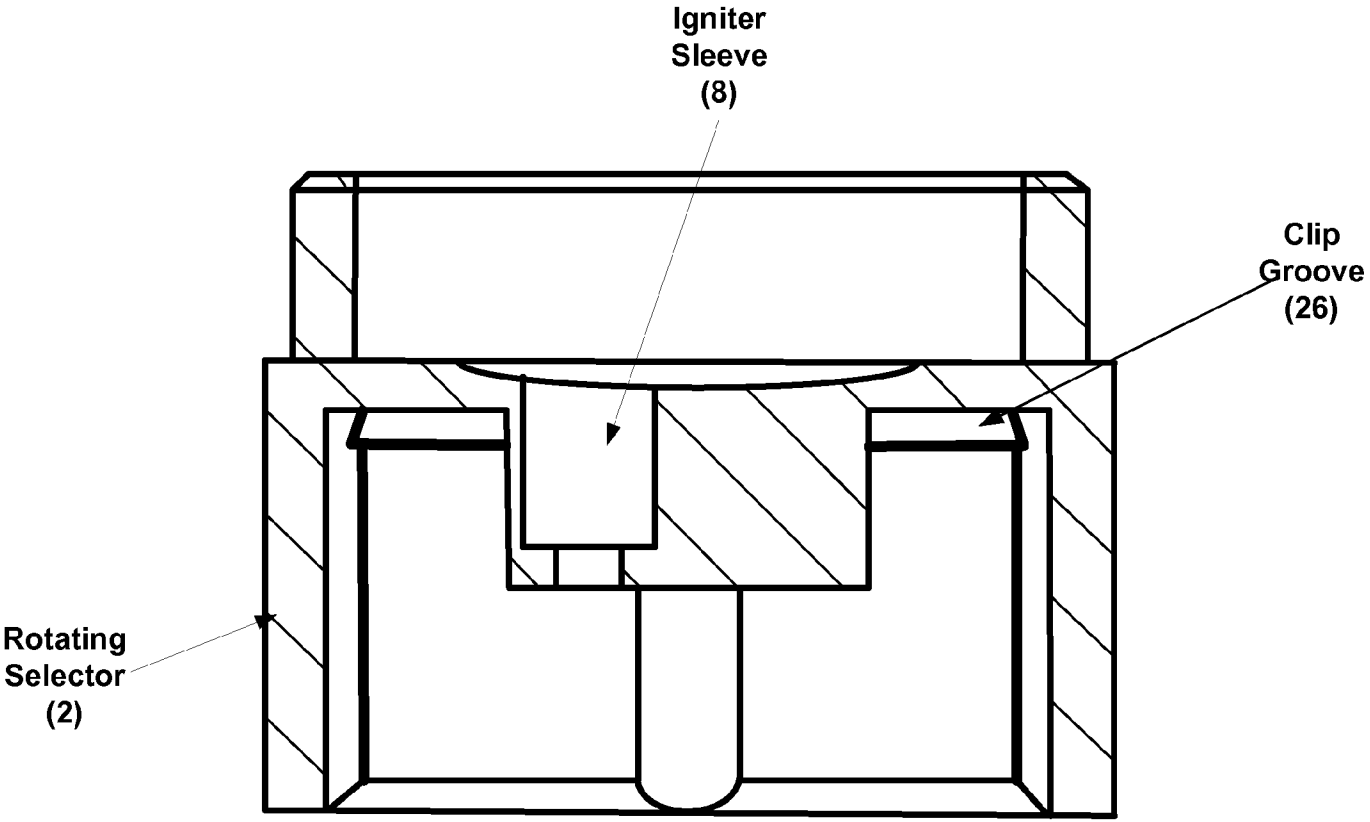
FIG. 5 is a schematic diagram showing an alternative view of the rotational variable pyrotechnic delay selector according to an aspect of the present disclosure.

FIG. 5 is a schematic diagram showing an alternative view of the rotational variable pyrotechnic delay selector according to an aspect of the present disclosure. As shown in this FIG. 5, the rotating selector 2 is engaged with the body 1 (not specifically shown in this FIG. 5) and is rotatable therearound. The clip groove 16 is used along with a body clip 25 (not specifically shown in this figure) to secure the selector 2 to the body 1 into an assembly. Igniter sleeve 8 positioned within the selector 2 will contain the igniter mixture (not shown) and by rotating the selector 2 the igniter mixture is aligned with a particular one of the delay column mixtures (not shown).

With these components now described, an operational discussion may proceed with simultaneous reference to FIGS. 1-5. As may be appreciated, a munition including an exemplary rotational variable delay selector according to the present disclosure may be understood.

Prior to the munition being chambered into a weapon system, a user will index the rotating selector 2 so that a desired range label 15 is aligned with an indicator arrow 16 on the body 1 of the delay system. Once aligned, a ball and spring plunger 7 will engage a mating groove 12 formed on an inner surface of the rotating selector 2.

As a result of this rotational alignment of the selector 2 with the body 1, an igniter mixture 9 will be aligned with a particular corresponding delay column mixture 3 specific to the engagement range chosen by the user. Upon ignition of the overall munition, all of the delay column mixtures 3 will be ignited and burn the specific rate they were designed for. The igniter mixture 9 is ignited when the delay column mixture 3 that is lined up with the igniter mixture 9 completes its designed burn time. As may be appreciated—the resulting ignition train is a combination of the igniter mixture 9 and the particular column mixture 3 in alignment with that mixture.

To prevent any of the unselected delay column mixtures 3 from igniting the igniter mixture 9, delay column seals 11 are inserted between the body 1 and the rotating selector 2. To prevent contamination by outside particles or moisture, a body seal 6 is assembled over the body 1, as well as seal disks 5 and igniter seal disks 10, which are placed over the end of the delay column holder 4 and igniter sleeve 8 respectively.

The delay column holder 4 and igniter sleeve 8 are preferably made of a material exhibiting sufficient structural integrity and thermal insulating characteristics so as to control burn rates by minimizing any heat loss through the outer walls. As may be appreciated by those skilled in the art, any of a variety of metallic, composite, plastic or other materials may provide such characteristics.

Fixed start and stop points for the rotational selector 2 are provided by a rotational stop block 13 which is positioned on the inner surface of the rotating selector 2 and rides along the rotating stop groove 14 that is formed into the top of the body 1. In order to secure the body 1 to the rotating selector 2, the rotating selector 2 is pressed over the body 1 in axial alignment until a body clip 15 on the body 1 is sufficiently inserted into a clip groove 16 on the rotating selector 2.

At this point, while we have discussed and described exemplary embodiments and configurations of the rotational variable pyrotechnic delay selector for munitions, those skilled in the art will appreciate that a number of variations to those described are possible and contemplated. For example, the delay selector is variable in size and therefore is adaptable to any of a number of different caliber sized munitions while providing the same functionality. Additionally, any of a variety of sufficient igniter and/or delay column pyrotechnic mixtures are contemplated and are all within a matter of design choice. Similarly, material construction is variable as well and any of a number of known materials and/or techniques may be employed in constructing variable delay selectors for munitions. Accordingly, the disclosure should be viewed as limited only by the scope of the claims that follow.

The invention claimed is:

1. A method for providing a variable delay to the ignition train of a munition comprising the steps of: rotating a rotating selector around a body of a delay selector such that an ignition mixture is in alignment with one of a plurality of delay mixtures; and securing the rotating selector in rotatable position such that an overall ignition train of the munition is produced by the ignition mixture and the aligned delay mixture, said method further comprising the step of: igniting all of the plurality of delay mixtures such that only the aligned delay mixture contributes to the overall ignition train.

* * * * *